US008739888B2

(12) United States Patent
O'Blenes

(10) Patent No.: US 8,739,888 B2
(45) Date of Patent: Jun. 3, 2014

(54) MECHANICALLY ACTUATED CASING DRIVE SYSTEM TOOL

(75) Inventor: Jonathan B. O'Blenes, Calgary (CA)

(73) Assignee: Tesco Corporation, Houston, TX (US)

( * ) Notice: Subject to any disclaimer, the term of this patent is extended or adjusted under 35 U.S.C. 154(b) by 428 days.

(21) Appl. No.: 13/096,426

(22) Filed: Apr. 28, 2011

(65) Prior Publication Data

US 2012/0273232 A1 Nov. 1, 2012

(51) Int. Cl.
*E21B 31/20* (2006.01)

(52) U.S. Cl.
USPC ..... 166/380; 166/77.51; 166/85.1; 166/98; 294/86.14; 294/86.22; 294/86.25

(58) Field of Classification Search
USPC ..... 166/380, 77.1, 77.51, 85.1, 98; 294/86.14, 86.22, 86.25
See application file for complete search history.

(56) References Cited

U.S. PATENT DOCUMENTS

| | | | | |
|---|---|---|---|---|
| 4,762,187 | A * | 8/1988 | Haney | 175/171 |
| 5,433,279 | A | 7/1995 | Tessari et al. | |
| 6,732,822 | B2 | 5/2004 | Slack et al. | |
| 6,742,584 | B1 | 6/2004 | Appleton | |
| 6,918,454 | B2 | 7/2005 | Prior et al. | |
| 6,938,697 | B2 * | 9/2005 | Haugen | 166/380 |
| 7,140,443 | B2 | 11/2006 | Beierbach et al. | |
| 7,191,840 | B2 * | 3/2007 | Pietras et al. | 166/380 |
| 7,270,189 | B2 | 9/2007 | Brown et al. | |
| 7,513,300 | B2 * | 4/2009 | Pietras et al. | 166/77.51 |
| 7,543,650 | B2 * | 6/2009 | Richardson | 166/379 |
| 7,591,304 | B2 * | 9/2009 | Juhasz et al. | 166/77.51 |
| 7,775,572 | B2 | 8/2010 | Slack | |
| 7,854,265 | B2 * | 12/2010 | Zimmermann | 166/379 |
| 7,896,111 | B2 | 3/2011 | Slack | |
| 2004/0173358 | A1 * | 9/2004 | Haugen | 166/380 |
| 2004/0216924 | A1 * | 11/2004 | Pietras et al. | 175/57 |
| 2007/0074874 | A1 * | 4/2007 | Richardson | 166/379 |
| 2007/0193751 | A1 * | 8/2007 | Pietras et al. | 166/380 |
| 2007/0240908 | A1 | 10/2007 | Brown et al. | |

(Continued)

FOREIGN PATENT DOCUMENTS

| | | |
|---|---|---|
| WO | 02086279 | 10/2002 |
| WO | 2006116870 | 11/2006 |
| WO | 2010006441 | 1/2010 |

OTHER PUBLICATIONS

"Top Drive Rig Floor Safety Orientation Doghouse Manual"—Tesco Corporation, Bulletin 20900e, available at http:\\www.tescocorp.com, last visited Nov. 30, 2010.

"250 HMI 475 Top Drive"—Tesco Corporation, available at http:\\www.tescocorp.com/bins/print_page.asp?cid=2-9-12, last visited Nov. 30, 2010.

(Continued)

*Primary Examiner* — Jennifer H Gay
(74) *Attorney, Agent, or Firm* — Bracewell & Giuliani LLP

(57) ABSTRACT

A casing gripper is stabbed into a casing and energized by a top drive, gripping the casing. The casing gripper includes a load bearing mandrel that has external threads. The casing gripper also includes a nut threaded over the external threads, and a wrench having a portion of the upper end of the load bearing mandrel inserted into an opening of the wrench. The wrench is configured to prevent rotation of the nut but allow axial movement while the op drive rotates the mandrel. The casing gripper includes a grapple coupled to the nut and extending along a portion of the lower end of the load bearing mandrel. The grapple moves axially with the nut an is configured to radially expand and engage a casing member.

18 Claims, 7 Drawing Sheets

(56) References Cited

U.S. PATENT DOCUMENTS

| | | | | |
|---|---|---|---|---|
| 2009/0114398 | A1* | 5/2009 | Buytaert et al. | 166/380 |
| 2009/0145594 | A1* | 6/2009 | Slack | 166/85.5 |
| 2009/0273201 | A1 | 11/2009 | Slack | |
| 2009/0321086 | A1* | 12/2009 | Zimmermann | 166/379 |
| 2012/0273232 | A1* | 11/2012 | O'Blenes | 166/380 |

OTHER PUBLICATIONS

Top Drive Drilling Schematic—available at http:\\dthrotarydrilling.com/News/3-Feb-2010/images/drilling-process.jpg, last visited Dec. 1, 2010.

PCT International Search report from PCT/US2012/034406, mailed on Jul. 22, 2013.

* cited by examiner

MECHANICALLY ACTUATED CASING DRIVE SYSTEM TOOL

BACKGROUND OF THE INVENTION

1. Field of the Invention

The present invention relates in general to a method and apparatus for placing a casing string in a well and, in particular, to an apparatus and method for gripping a pipe element from a top drive.

2. Brief Description of Related Art

During drilling of an oil and gas well, the wellbore is typically lined with tubular members, i.e., casing. Casing maintains the drilled wellbore opening and allows for the passage of tools, drilling fluids, drilled material, and produced hydrocarbons into and out of the wellbore. Casing is assembled in a process that involves lowering a portion of casing into the wellbore, gripping the casing through use of a pipe slips or an elevator, and maintaining the casing position while a separate elevator brings a new section of casing to the gripped portion, connects the new portion, and then lowers the combined sections further into the well. When the newly connected casing is substantially in the wellbore, the process repeats. This can be a time consuming and dangerous process as it can place workers in precariously high places in order to facilitate the connection of additional casing, and in areas where they may be prone to being struck by the moving casing elements.

In an effort to reduce the risks associated with running in casing strings, some systems utilize a top drive to both drill the wellbore and run casing. Top drive systems utilize a high horsepower motor and gearbox mounted to the drilling derrick axially above and in line with the wellbore. Top drives can move axially as needed to conduct drilling operations, and be shifted horizontally to a limited degree. When used to run casing, a hydraulically actuated casing gripper may be coupled to the top drive such that the top drive may variably raise and lower the casing gripper as needed to first secure a separate casing element and then couple that casing element to the casing string. Due to the nature of the design of the hydraulic systems of the casing gripper, the casing gripper causes the length of the casing drive system stack to be quite large. The length of these systems prevents the use of hydraulically actuated casing grippers in smaller drilling rigs that typically run casing that is only 4.5" to 5.5" in diameter. These smaller rigs have shorter masts, or are sometimes converted rigs that added a top drive system. In those rigs, a hydraulic casing gripper may be too long to fit into the drilling rig.

Attempts have been made to address some issues with hydraulically actuated gripping devices by removing the hydraulic elements and replacing them with a mechanically actuated system. These mechanically actuated devices generally rely on complicated systems that variably engage and disengage a series of cams and hooks that must transition between setting modes and torque modes where the nuts variably engage or disengage the gripping mechanism. Increased complexity often leads to an increased rate of failure as there are more moving pieces that can fail and cause the gripping device to cease functioning. Furthermore, these devices often utilize elastomeric elements that are compressed into engagement with an interior diameter of a casing member. These elastomeric elements are prone to wear and failure after repeated uses, increasing the downtime of the gripping device for maintenance and repair. Oftentimes, these devices also require significant operator preparation time to ensure that the particular device is suited for the particular type of casing or tubular member to be gripped. Other mechanically actuated systems grip casing by first stabbing a gripping tool into a casing element. A weight is then set on the casing element to hold the casing element stationary while the gripping tool actuates to grip the casing element. If the frictional force between the weight and the casing element is not sufficiently high, the tool will rotate within the casing element will rotate with the tool prior to tool actuation, thus preventing the gripping tool from actuating and gripping the casing.

SUMMARY OF THE INVENTION

In accordance with an embodiment of the present invention, a casing gripper comprises a load bearing mandrel defining a central bore cavity having a central axis. The casing gripper also comprises a rotary to linear converter enclosing a portion of the mandrel. The rotary to linear converter is configured to convert rotary motion of the load bearing mandrel into linear motion by a lower portion of the converter when an upper portion of the converter is held stationary. The casing gripper also comprises a grapple coupled to the lower portion of the converter and extending along a portion of the load bearing mandrel for axial movement therewith. Axial movement of the grapple causes the grapple to move radially and engage a casing member.

In accordance with another embodiment of the present invention, an apparatus for gripping casing comprises a load bearing mandrel having a central axis and adapted to be secured to a quill of a top drive. The load bearing mandrel has external threads on a portion of the load bearing mandrel between an upper end and a lower end, and a nut threaded over the external threads. An upper mandrel housing surrounds the nut and a portion of the load bearing mandrel above the nut. The housing and the nut are capable of rotating in unison, the nut being axially moveable relative to the housing. The housing is adapted to be inserted into a top drive grabber. A grapple couples to the nut for axial movement relative to the mandrel, and extends along a portion of the lower end of the load bearing mandrel. The grapples are radially moveable to grip a casing member when moved axially in one direction and to release the casing member when moved axially in an opposite direction. Gripping the housing by the grabber and rotating the quill causes the nut and grapples to move axially.

In accordance with still another embodiment, a system for handling casing comprises a top drive having a rotatably driven quill and a grabber coupled to and suspended below the top drive. A load bearing mandrel operably couples to the quill for rotation therewith, the load bearing mandrel defining a central bore cavity having a central axis and extending through the grabber. A rotary to linear converter encloses a portion of the mandrel and inserts into the grabber, such that when the grabber restrains rotation of the converter, and the quill rotates the mandrel, a lower portion of the converter moves axially. A grapple couples to the lower portion of the converter and extends along a portion of the load bearing mandrel for axial movement therewith. The axial movement of the grapple causes the grapple to move radially and engage a casing member.

In accordance with yet another embodiment, a method for gripping a casing with a top drive of a drilling rig having a grabber mounted to the top drive comprises providing a casing gripper having a load bearing mandrel having a central axis, and a rotary to linear converter enclosing a portion of the mandrel and inserted into the grabber. The converter has an upper portion and a lower portion, the lower portion being rotatable with the upper portion but axially movable relative to the upper portion. The casing gripper also comprises a grapple coupled to the lower portion of the converter and extending along a lower portion of the load bearing mandrel. The method continues by gripping the upper portion of the converter with the grabber and securing the mandrel to the quill, and then, positioning the grapple into reception with the casing. The method concludes by rotating the quill and the mandrel while holding the upper portion of the converter stationary with the grabber. This causes the lower portion of the converter and the grapple to move axially, the grapple moving radially in response to grip the casing.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiments thereof which are illustrated in the appended drawings, which drawings form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning drilling rig operation, materials, and the like have been omitted inasmuch as such details are not considered necessary to obtain a complete understanding of the present invention, and are considered to be within the skills of persons skilled in the relevant art.

Figure 1:
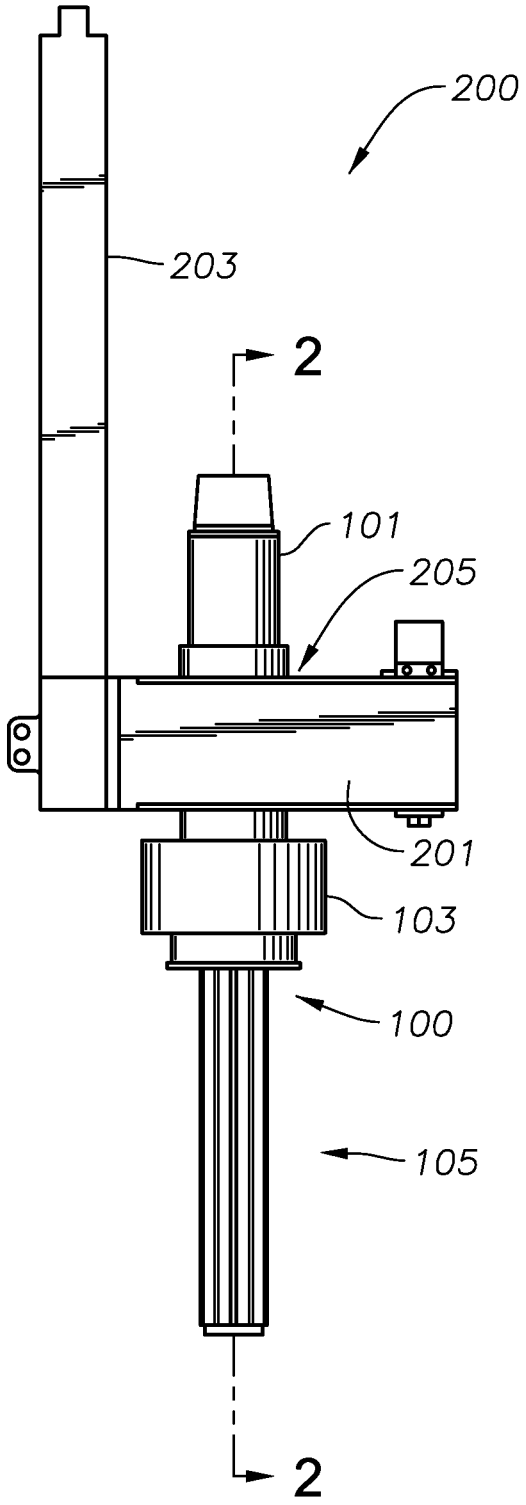
FIG. 1 is a side view of a mechanically actuated casing drive system in accordance with an embodiment of the present invention coupled to a top drive grabber.

FIG. 1 illustrates a casing gripper 100 and a grabber 200 of a top drive (not shown in FIG. 1). Casing gripper 100 comprises a load bearing mandrel 101, a wrench 103, and a grapple cluster 105. Grabber 200 comprises a conventional top drive grabber 201 configured to alternately grip and release wrench 103, and a grabber leg 203 that secures grabber 200 to the top drive, configured to position casing gripper 100 axially beneath and coupled to a quill of the top drive. Grabber 200 moves up and down the rig derrick in unison with the top drive. In typical operation of a top drive having grabber 200, grabber 200 acts like a back-up tong and closes onto a tool joint to arrest the reactive torque caused by rotation of the top drive when making up or breaking out a connection. Grabber 200 is described in more detail with respect to FIG. 4 and FIG. 5.

Figure 2:
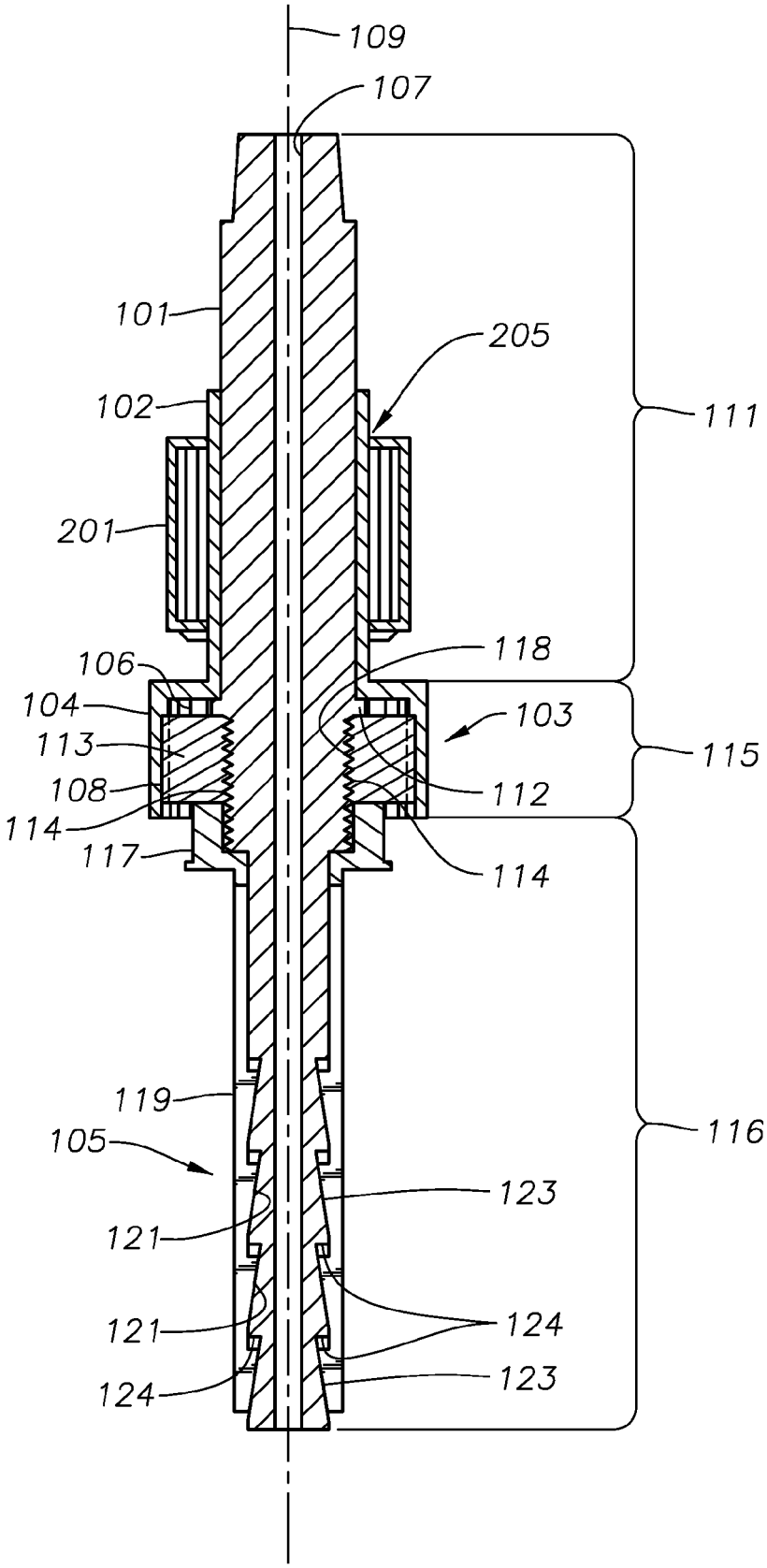
FIG. 2 is an enlarged section view of FIG. 1 taken along line 2-2.

As shown in FIG. 2, load bearing mandrel 101 preferably defines a central passage 107 having an axis 109 allowing drilling fluids and other materials to pass through casing gripper 100 into a casing string (not shown in FIG. 1). A person skilled in the art will understand that alternative embodiments do not include central passage 107. Load bearing mandrel 101 further comprises an upper portion 111 of a first diameter, a middle portion 115 of a second diameter, and a lower portion 116 of a third diameter.

Upper portion 111 has a tapered upper end configured with threads for coupling to a quill of the top drive. Preferably, the tapered upper end is configured for an oil field connection. Upper portion 111 is of sufficient length to extend from below top drive grabber 201 through an opening 205 in top drive grabber 201 and extend a distance between a top surface of top drive grabber 201 and a quill of the top drive. An upward facing shoulder 112 separates upper portion 111 from middle portion 115. Upward facing shoulder 112 comprises an annular protrusion from the surface of load bearing mandrel 101 having a diameter slightly larger than upper portion 111.

Middle portion 115 defines a threaded middle section of load bearing mandrel 101 between upper portion 111 and lower portion 116. Preferably, the diameter of middle portion 115 is smaller than the diameter of upper portion 111. A surface of load bearing mandrel 101 at middle portion 115 defines a plurality of threads 114 extending from upward facing shoulder 112 to the diameter change of load bearing mandrel 101 between middle portion 115 and lower portion 116. Preferably, middle portion 115 is of a length such that threads 114 will allow a nut 113 threaded onto load bearing mandrel 101 at middle portion 115 to travel axially up and down middle portion 115 as described in more detail below with respect to FIGS. 6 and 7.

Figure 3:
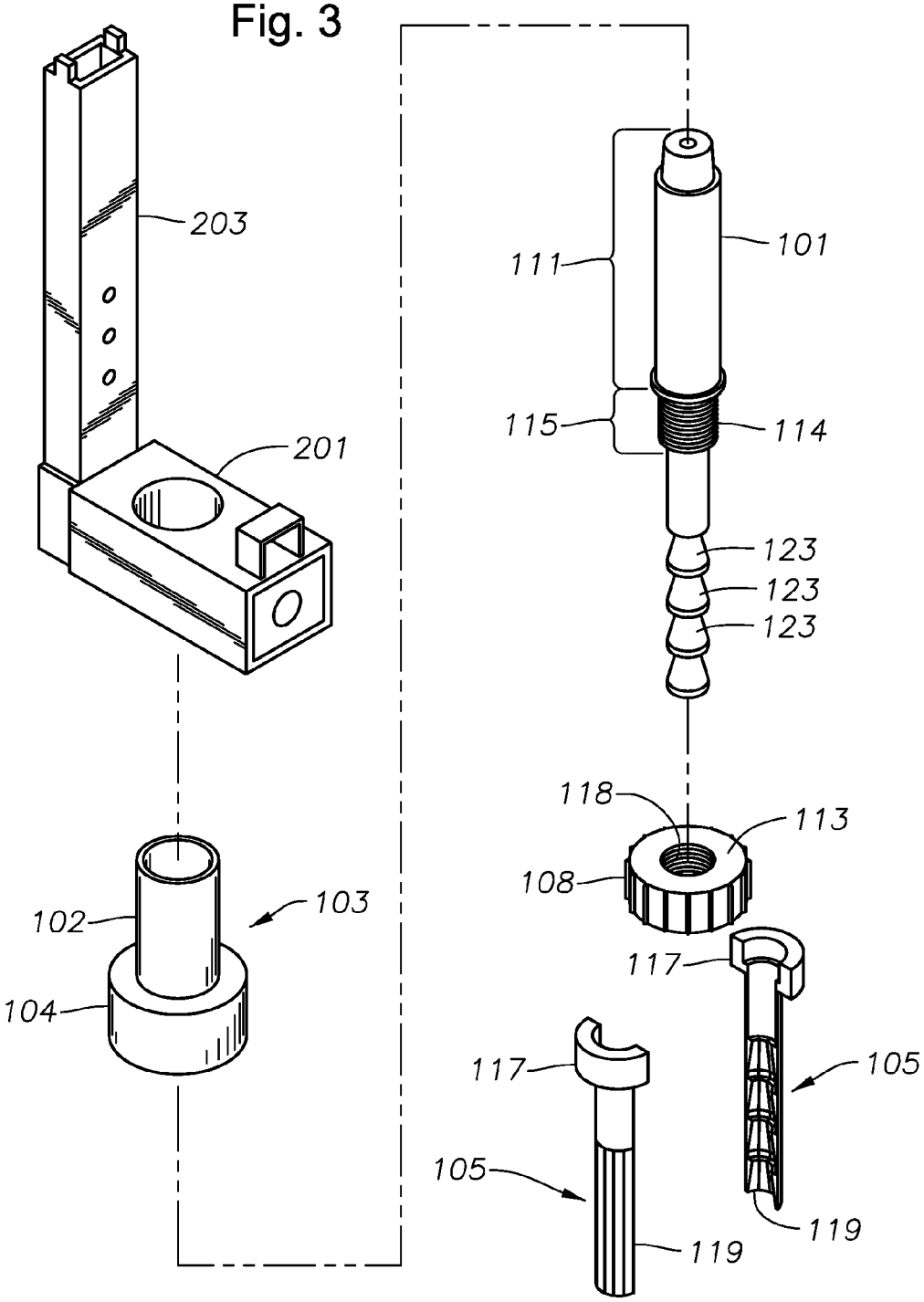
FIG. 3 is an assembly drawing of the embodiment of FIG. 1.

Lower portion 116 comprises a portion of load bearing mandrel 101 configured to stab into a tubular member such as a casing. Preferably, lower portion 116 has a smaller diameter than middle portion 115 and upper portion 111 such that lower portion 116 may insert into nut 113, allowing nut 113 to thread onto middle portion 115, as shown in FIG. 3. Lower portion 116 is of a sufficient length to provide sufficient contact area between grapples 119, described in more detail below, and an inner surface of a tubular member such that load bearing mandrel 101 may clamp to and secure a tubular member for subsequent movement.

Lower portion 116 also defines a plurality of mandrel ramps 123. In the illustrated embodiment, there are four mandrel ramps 123. A person skilled in the art will understand that more or fewer mandrel ramps 123 may be used depending on the particular application. Each mandrel ramp 123 comprises a lower outer diameter of approximately the diameter of load bearing mandrel 101 comprising lower portion 116, and an upper inner diameter smaller than the diameter of load bearing mandrel 101 comprising lower portion 116. The plurality of mandrel ramps 123 are stacked concentrically such that the upper inner diameter of a lower mandrel ramp 123 joins an upper mandrel ramp 123 at the lower outer diameter of the upper mandrel ramp 123, thereby forming a plurality of downward facing mandrel shoulders 124. Mandrel ramps 123 are sized based on tool geometry, the approximate tensile load of the casing string that the casing gripper 100 will be subjected to, and the other particular features of the particular application where casing gripper 100 is used.

Wrench 103 comprises an annular body having an upper portion sleeve 102 defining a first cavity having a first wrench diameter slightly larger than the diameter of upper portion 111 of load bearing mandrel 101. As shown in FIG. 3, upper portion 111 inserts into sleeve 102 until an edge formed by the first wrench diameter of sleeve 102 rests on upward facing shoulder 112. Wrench 103 may then rotate about load bearing member 101. Wrench 103 further comprises a lower portion nut sleeve 104 defining a second cavity having a second wrench diameter slightly larger than an outer diameter of nut 113. The second cavity surface of wrench 103 comprises vertical splines 106 configured to engage corresponding splines 108 on nut 113 (FIG. 3). Splines 106 of wrench 103 are of a sufficient size, shape, and number to engage nut 113 and variably allow and disallow nut 113 to rotate as described below.

As shown in FIG. 3, nut 113 threads on middle portion 115 of load bearing mandrel 101. Preferably, external threads 114 of middle portion 115 and threads 118 of nut 113 comprise left handed threads. Nut 113 further defines splines 108 formed on an exterior diameter surface of nut 113 corresponding to splines 106 of wrench 103. When engaged, the corresponding splines 106,108 of wrench 103 and nut 113 will allow nut 113 to move axially relative to wrench 103 while preventing nut 113 from rotating independently of wrench 103.

Wrench 103 and nut 113 jointly comprise a rotary to linear motion converter. During operation of casing gripper 100, the rotary to linear motion converter, comprised of wrench 103 and nut 113, operates to convert rotary motion imparted to load bearing mandrel 101 by the top drive into linear motion of grapple cluster 105. Generally, the rotary to linear converter operates by holding wrench 103 stationary. Splines 106 of wrench 103 engage splines 108 of nut 113, thus preventing rotation of nut 103. In response, by moving nut 113 axially along threads 114, the rotary to linear converter causes nut 103 to move linearly along axis 109 of load bearing mandrel 101 as load bearing mandrel 101 rotates. Operation of the rotary to linear converter is described in more detail with respect to FIGS. 6-7.

In alternative embodiments, a locking mechanism is employed to prevent undesired disengagement of casing gripper 100. The locking mechanism may comprise any suitable means for preventing undesired reverse rotation of nut 113. Preferably, the locking mechanism will comprise an automatic device that actuates following engagement of grapples 119 as described in more detail below. The locking mechanism may comprise a ratchet-type dog, such as an over center latch configured to engage nut 113 and prevent undesired reverse rotation following engagement of grapples 119. Alternatively, the locking mechanism may comprise a separate piece, splined such that nut 113 will engage the separate piece following engagement of grapples 119. A person skilled in the art will understand that the disclosed embodiments contemplate and include any suitable locking mechanism configured to prevent undesired disengagement of casing gripper 100.

Grapple cluster 105 comprises a grapple mounting flange 117 having a downward facing shoulder and a plurality of grapples 119. Grapple mounting flange 117 couples to a lower surface of nut 113 such that rotation or axial movement of nut 113 will move grapple mounting flange 117 in response. In a preferred embodiment, grapple mounting flange 117 couples to nut 113 by bolts. A person skilled in the art will understand that the invention contemplates and includes other coupling methods such as threaded members and the like.

Grapples 119 comprise extensions of grapple mounting flange 117 protruding axially downward from a lower surface of grapple mounting flange 117. In a preferred embodiment, slots are formed in grapples 119 by machining, thereby creating individual grapples joined at upper and/or lower ends of grapples 119. The machined slots allow the individual grapples to support the adjacent grapples in resisting the torsional force applied as the individual grapples engage, thereby preventing grapples 119 from wrapping around lower portion 116 of load bearing mandrel 101 under load. An interior surface of grapples 119 abuts a surface of lower portion 116 of load bearing mandrel 101. The interior surfaces of grapples 119 define a plurality of ramps 121. Ramps 121 comprise annular upward facing ridges having their narrowest diameter axially upward and their widest diameter axially downward and configured to abut and conform to mandrel ramps 123. Each ramp 121 is axially aligned such that the widest portion of a lower ramp 121 meets the adjacent upper ramp 121 at the narrowest portion of the upper ramp 121. Preferably, each ramp 121 abuts a corresponding mandrel ramp 123.

In a preferred embodiment, grapple mounting flange 117 and grapples 119 are formed in two halves (as shown in FIG. 3) and are bolted to nut 113 such that mounting flange 117 and grapples 119 surround lower portion 116 of load bearing mandrel 101. Preferably, grapples 119 are formed of steel. A person skilled in the art will understand that any suitable material of sufficient strength to withstand the required torsional and tensile forces for the particular application are contemplated and included by the disclosed embodiments.

Figure 4:
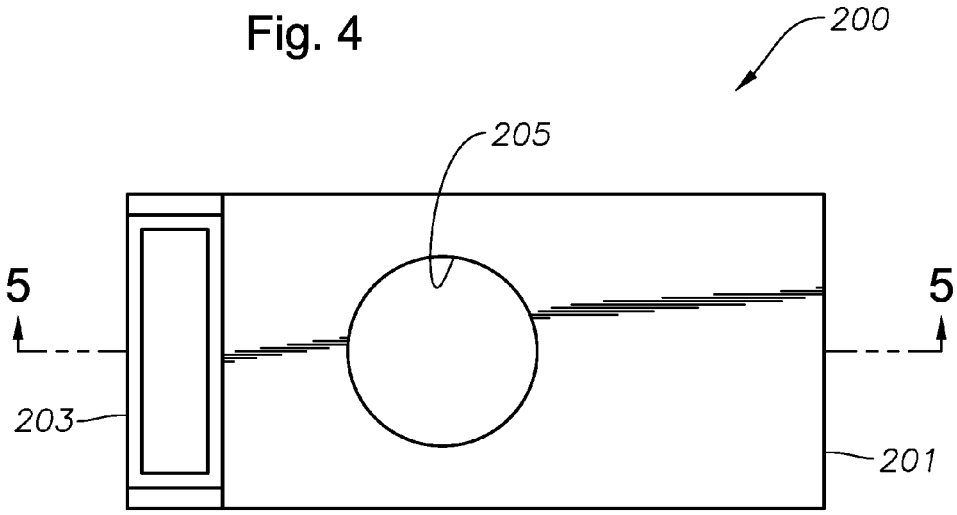
FIG. 4 is a top view of the grabber of FIG. 1 with the casing drive system removed.

Referring to FIG. 4, grabber 200 comprises top drive grabber 201 and grabber leg 203. Grabber leg 203 couples to a top of top drive grabber 201 near a first end of top drive grabber 201 and further couples to a top drive. A person skilled in the art will understand that grabber leg 203 may alternatively couple to an end of top drive grabber 201 relative to the top drive. Preferably, grabber leg 203 will move vertically relative to the top drive, allowing for adjustment of top drive grabber 201. Top drive grabber 201 defines opening 205 located coaxially beneath a quill of the top drive. A diameter of opening 205 is of sufficient size to allow for insertion of upper portion 111 of load bearing mandrel 101 and the upper portion of wrench 103 of FIG. 1 into opening 205 as shown in FIGS. 1-3.

Figure 5:
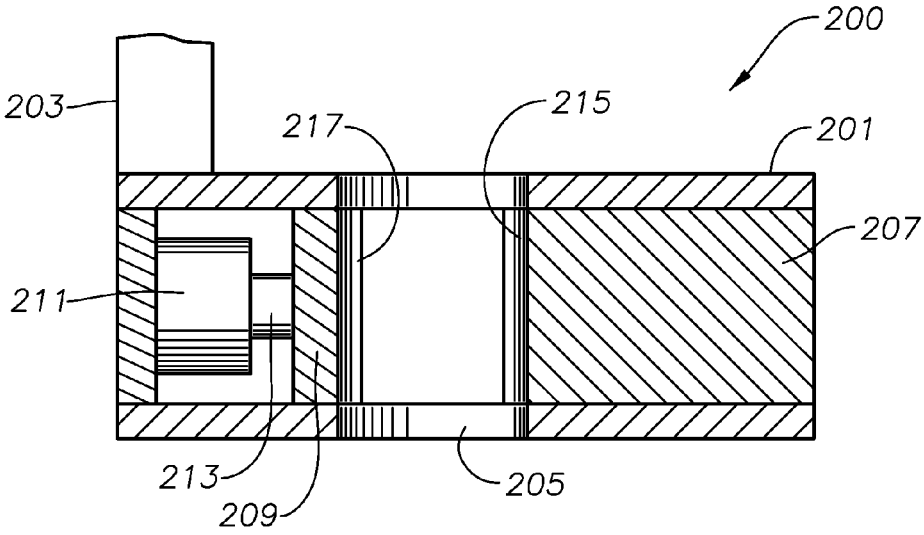
FIG. 5 is a section view of the grabber of FIG. 6 taken along line 5-5.

FIG. 5 provides a cross sectional view of grabber 200 taken along line 5-5 of FIG. 4. As illustrated in FIG. 5, top drive grabber 201 defines an enclosure housing additional elements of top drive grabber 201. Top drive grabber 201 comprises a stationary clamp 207, a movable clamp 209, and a piston 211. Stationary clamp 207 affixes to an interior end of the enclosure of top drive grabber 201 opposite the first end. Stationary clamp 207 comprises a fixed element having a curved surface 215 proximate to opening 205 such that an object having a diameter smaller than that of opening 205, such as sleeve 102 of wrench 103, will abut curved surface 215, substantially covering curved surface 215. Stationary clamp 207 is constructed of a material such that curved surface 215 will resist deformation when exposed to a force perpendicular to curved surface 215.

Movable clamp 209 is moveably coupled in a portion of the enclosure of top drive grabber 201 opposite stationary clamp 207. Movable clamp 209 has a curved surface 217 proximate to opening 205 such that an object having a diameter slightly smaller than that of opening 205, such as sleeve 102 of wrench 103, will abut curved surface 217 when moveable clamp 209 is at a point of maximum horizontal movement. Moveable clamp 209 is configured to alternately engage and disengage a tubular member inserted through opening 205 between curved surface 217 and curved surface 215. Moveable clamp 209 is constructed of a material such that curved surface 217 will resist deformation when exposed to a force perpendicular to curved surface 217.

Piston 211 comprises a piston coupled to an interior end of top drive grabber 201 opposite stationary clamp 207. Piston 211 further comprises a piston rod 213 coupled to a surface of moveable clamp 209 opposite curved surface 217. Piston 211 is configured to actuate piston rod 213 and exert a horizontal force against moveable clamp 209 alternately engaging and disengaging moveable clamp 209 from a tubular member inserted into opening 205, such as wrench 103.

In an operative embodiment, a tubular member, such as casing or wrench 103 of casing gripper 100 of FIG. 1, is inserted into opening 205. Based on a communicative input, piston 211 variably actuates piston rod 213 to bring curved surface 217 of moveable clamp 209 into contact with a surface of wrench 103. Continued movement of piston rod 213 brings the surface of wrench 103 opposite curved surface 217 into contact with curved surface 215. Continued movement of piston rod 213 compresses wrench 103 between curved surfaces 215, 217, clamping wrench 103 between curved surface 217 of moveable clamp 209 and curved surface 215 of stationary clamp 207. In this manner, top drive grabber 201 may alternately clamp wrench 103, preventing rotation of wrench 103, and release wrench 103, allowing rotation of wrench 103 with load bearing mandrel 101. A person skilled in the art will understand that the relative positions of stationary clamp 207 and moveable clamp 209 within top drive grabber 201 may change. Alternatively, both stationary clamp 207 and moveable clamp 209 may couple to pistons allowing for both to engage in clamping action.

Figure 6:
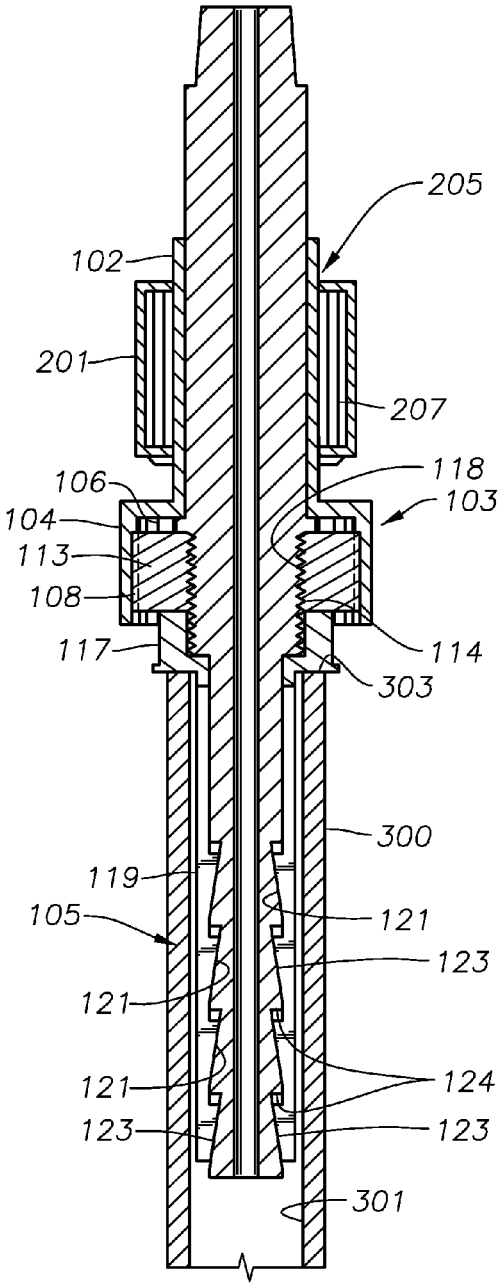
FIG. 6 is sectional view of the embodiment of FIG. 1 stabbed into a tubular member, such as a casing.
Figure 7:
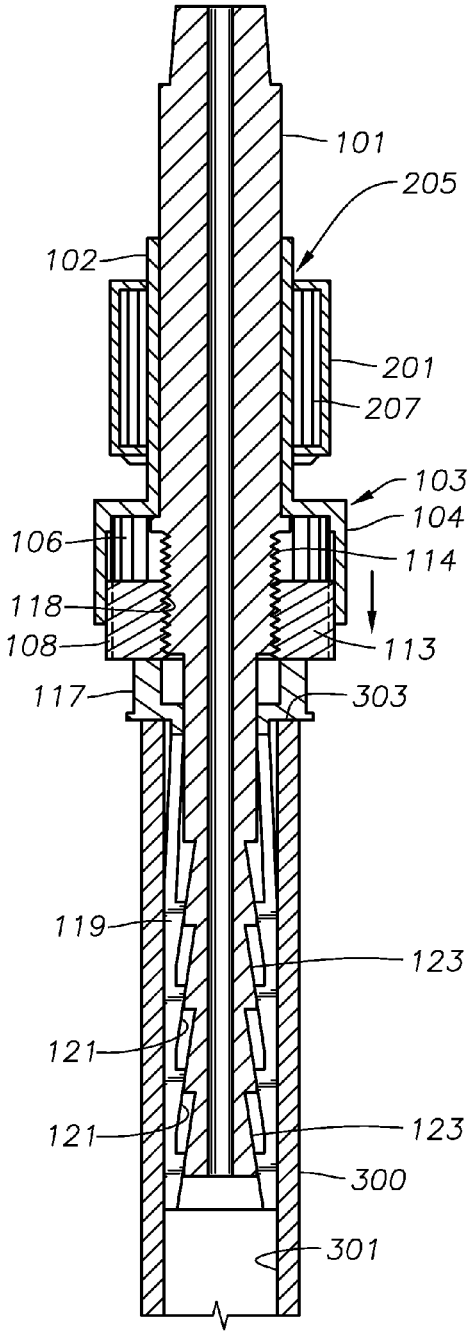
FIG. 7 is a sectional view of the embodiment of FIG. 1 energized in the tubular member of FIG. 6.

Referring now to FIGS. 6 and 7, the quill of the top drive is coupled to the tapered end of upper portion 111 of load bearing mandrel 103. The top drive is then oriented over a casing 300 such that lower portion 116 of load bearing mandrel 101 is proximate to a central bore 301. Preferably, central bore 301 is coaxial with axis 109. Lower portion 116 of load bearing mandrel 101 is then stabbed into casing 300 until an upper rim 303 of casing 300 abuts the lower surface of grapple mounting flange 117 as shown in FIG. 6.

Top drive grabber 201 then clamps on an upper portion of wrench 103 such that wrench 103 remains stationary when the top drive rotates load bearing mandrel 101. The corresponding splines 106, 108 of nut 113 and wrench 103 engage such that wrench 103 will prevent rotation of nut 113. The top drive is then rotated in a first direction. This first direction rotation causes the left handed threads 118 of nut 113 to move nut 113 axially downward relative to load bearing mandrel 101. In turn, grapple mounting flange 117 moves axially downward forcing ramps 121 of grapples 119 to slide axially downward along the surfaces of mandrel ramps 123. This causes grapples 119 to expand radially outward as shown in FIG. 7. The radial expansion clamps grapples 119 to the interior surface of casing 300.

Rotation of load bearing mandrel 101 continues until the desired clamping force from grapple 119 to casing 300 is reached. Preferably, the desired clamping force corresponds to a 3 inch to 4 inch downward axial movement of grapples 119. The number of threads 114 on load bearing mandrel 101 correspond to this 3 inch to 4 inch axial movement of grapples 119. Similarly, splines 106 of wrench 103 are of sufficient length, preferably 5 inches, to allow wrench 103 to remain engaged with nut 113 following full engagement of grapples 119.

Following achievement of the desired clamping force, top drive grabber 201 releases wrench 103, allowing wrench 103 to rotate with load bearing mandrel 103 when the top drive quill is rotated. In this manner, the top drive can continue a casing run in operation as described below with respect to FIGS. 8-11.

Once a casing member of casing 300 is properly placed, top drive grabber 201 again closes on the upper portion of wrench 103 such that wrench 103 remains stationary when the top drive rotates load bearing mandrel 101. The corresponding splines 106, 108 of nut 113 and wrench 103 engage such that wrench 103 will prevent rotation of nut 113. The top drive is then rotated in a second direction. This second direction rotation causes the left handed threads 118 of nut 113 to move nut 113 axially upward relative to load bearing mandrel 101. In turn, grapple mounting flange 117 moves axially upward, forcing ramps 121 of grapples 119 to slide axially upward along the surfaces of mandrel ramps 123. This movement pulls grapples 119 radially inward as shown in FIG. 6, releasing casing 300, allowing the top drive and casing gripper 100 to clamp to another casing.

Figure 8:
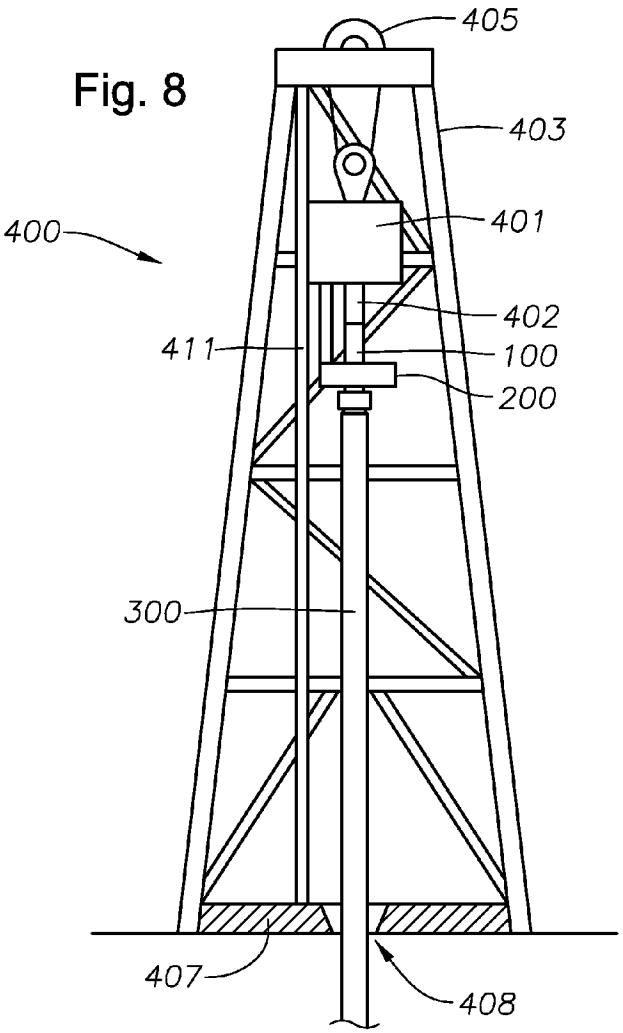

Referring now to FIGS. 8-11, there is shown an exemplary drilling rig 300 illustrating operative steps of a casing running operation using casing gripper 100 of FIG. 1. Drilling rig 400 comprises a top drive 401, a derrick 403, a blocks assembly 405, grabber 200, casing gripper 100, casing string 300, a rig floor 407 having an opening 408, pipe slips or spider 409, and a vertical rail 411. As illustrated in FIG. 8, blocks assembly 405 have lifted top drive 401 to a point of maximum vertical lift in derrick 403 over rig floor 407. Casing gripper 100 is coupled to a quill 402 of top drive 401 such that wrench 103 of casing gripper 100 is inserted into opening 205 of top drive grabber 201 as shown in FIG. 1. In the embodiment illustrated in FIG. 8, casing gripper 100 is energized, thereby gripping casing string 300. Pipe slips 409 have been removed from opening 408 to allow top drive 401 to lower casing string 300 into a wellbore.

Figure 9:
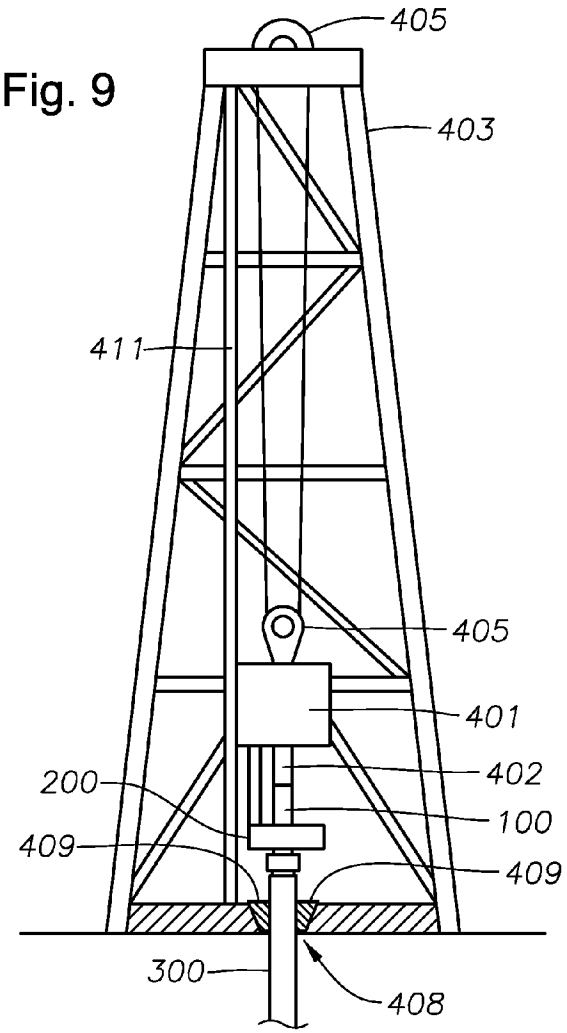
FIGS. 8-11 illustrate operative steps of a running operation using the casing gripper of FIG. 1.
Figure 11:
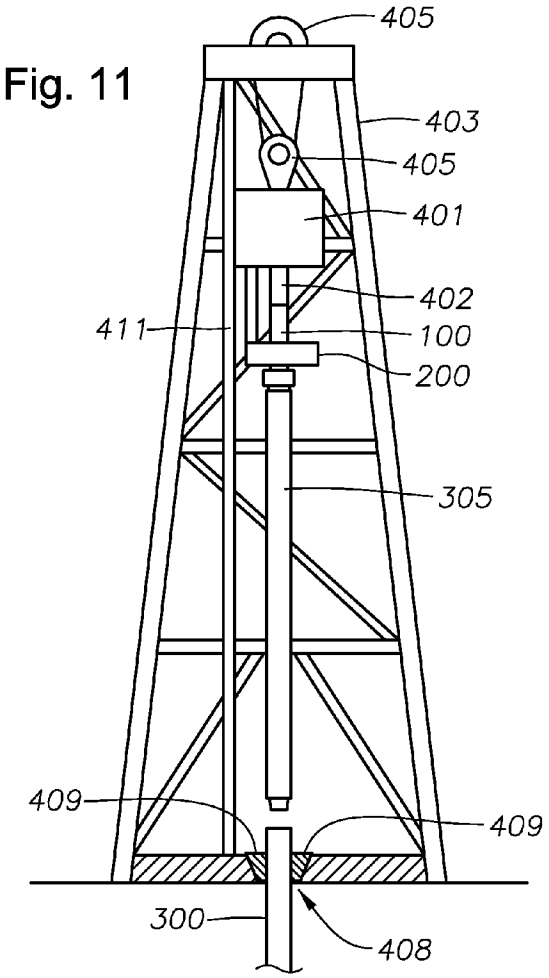
Figure 10:
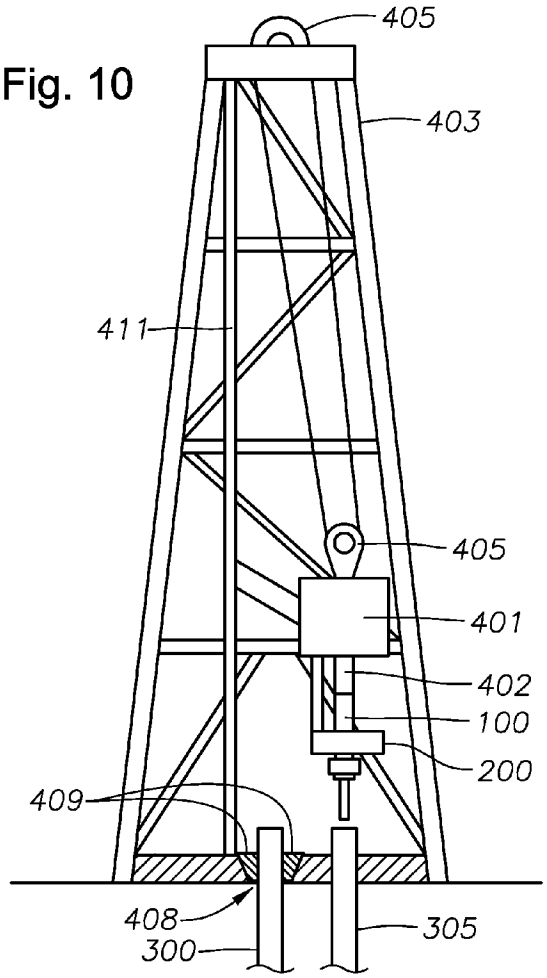

Referring now to FIG. 9, blocks assembly 405 lowers top drive 401 along rail 411, thereby lowering casing string 300 into the wellbore. Movement stops at a point when, as shown in FIG. 9, casing string 300 may still be gripped by pipe slips 409 in opening 408 while a new casing element 305 may be made up over the casing string 300. Pipe slips 409 are inserted into opening 408. Top drive 401 then raises slightly and then lowers slightly to set pipe slips 409 into gripping engagement with casing string 300. Casing gripper 100 is then de-energized, as described above, and top drive 401 raises casing gripper 100 out of casing string 300. If casing drilling is occurring, top drive 401 will rotate casing 300 and pump drilling fluid into casing 300 as casing 300 moves downward. An elevator (not shown) pivotally mounted to top drive 401 will pick up a new casing element 305 and align it with casing gripper 100 as illustrated in FIG. 10. Top drive 401 then stabs casing gripper 100 into casing element 305 and energizes casing gripper 100 as described above with respect to FIG. 7. Top drive 401 lifts vertically along rails 411 and moves casing element 305 axially over casing string 300 as shown in FIG. 11. Casing element 305 is then lowered and connected to casing string 300 as shown in FIG. 8, where the process repeats until sufficient casing has been run into the wellbore.

Accordingly, the disclosed embodiments provide numerous advantages over prior devices for gripping casing. The disclosed embodiments provide the minimum practical height for a casing drive system utilizing a top drive. This allows the disclosed embodiments to be used in smaller rigs running casing 4.5" to 5.5". Sufficient radial clamping force to grip a casing string is imparted and maintained by the nut. This is achieved with mechanical actuation without relying on a friction actuated gripper. In addition, an operator can specifically dial in the desired amount of clamping force, unlike hydraulically actuated casing grippers. Furthermore, the casing gripper disclosed herein engages and disengages using only the top drive, no additional equipment or tools are needed to engage the casing gripper with the casing element to be gripped. The present embodiments accomplish these improvements without the overly complex and prone to failure systems of prior art non-hydraulically actuated casing grippers.

While the invention has been shown or described in only some of its forms, it should be apparent to those skilled in the art that it is not so limited, but is susceptible to various changes without departing from the scope of the invention. For example, the grapples could be arranged to grip an exterior of the casing rather than an interior.

What is claimed is:

1. A casing gripper comprising:

a load bearing mandrel defining a central bore cavity having a central axis and adapted to be secured to a quill of a top drive, the load bearing mandrel having external threads on a portion of the load bearing mandrel between an upper end and a lower end;

a rotary to linear converter enclosing a portion of the mandrel and configured to convert rotary motion of the load bearing mandrel into linear motion by a lower portion of the converter when an upper portion of the converter is held stationary, the rotary to linear converter having:

a nut threaded over the external threads of the load bearing mandrel;

a wrench surrounding the nut and a portion of the load bearing mandrel above the nut, the upper portion of the wrench having an outer diameter smaller than the outer diameter of the lower portion of wrench;

the wrench and the nut being rotatable in unison, the nut being axially moveable relative to the wrench; and the wrench adapted to be inserted into and selectively secured by a grabber of a top drive;

a grapple coupled to the lower portion of the converter and extending along a portion of the load bearing mandrel for axial movement therewith, wherein gripping the wrench by the grabber and rotating the quill causes the nut and grapples to move axially; and the grapple being radially moveable to grip a casing member when moved axially in one direction and to release the casing member when moved axially in an opposite direction.

2. The casing gripper of claim 1, wherein the external threads on the load bearing mandrel and the threads of the nut comprise left hand threads.

3. The casing gripper of claim 1, wherein:

the nut further comprises splines on an outer diameter surface of the nut;

the wrench comprises an upper portion and a lower portion defining a cavity;

wherein the cavity has an inner diameter larger than the outer diameter of the nut; and wherein the cavity has splines on an inner diameter surface that mate with the splines of the nut.

4. The casing gripper of claim 3, wherein the splines of the nut and the splines of the wrench engage such that the wrench rotationally secures the nut while still allowing the nut to move axially during engagement.

5. The casing gripper of claim 1, wherein the lower end of the load bearing mandrel defines a plurality of axially aligned conical surfaces having a smaller inner diameter proximate to the external threads, and a corresponding larger outer diameter proximate to the lower end of the load bearing mandrel.

6. The casing gripper of claim 5, wherein the smaller inner diameter is axially upward, and the larger outer diameter is axially downward for engagement by mating portion of the grapples.

7. The casing gripper of claim 5, wherein an inner surface of the grapple comprises a plurality of ramps configured to engage a plurality of axially aligned conical surfaces on a portion of the lower end of the load bearing mandrel having a smaller inner diameter proximate to the external threads, and a corresponding larger outer diameter proximate to the lower end of the load bearing mandrel.

8. The casing gripper of claim 1, further comprising:

a grapple mounting flange coupled to the nut; and wherein the grapple is coupled to the grapple mounting flange.

9. A system for handling casing comprising:

a top drive having a rotatably driven quill;

a grabber coupled to and suspended below the top drive;

a load bearing mandrel operably coupled to the quill for rotation therewith, the load bearing mandrel defining a central bore cavity having a central axis and extending through the grabber, the load bearing mandrel having external threads on a portion of the load bearing mandrel between an upper end and a lower end;

a rotary to linear converter enclosing a portion of the mandrel and inserted into the grabber, such that when the grabber restrains rotation of the converter, and the quill rotates the mandrel, a lower portion of the converter moves axially, the rotary to linear converter having:

a nut threaded over the external threads of the load bearing mandrel;

a wrench surrounding the nut and a portion of the load bearing mandrel above the nut, the upper portion of the wrench having an outer diameter smaller than the outer diameter of the lower portion of wrench;

the wrench and the nut being rotatable in unison, the nut being axially moveable relative to the wrench; and the wrench adapted to be inserted into and selectively secured by the grabber;

a grapple coupled to the lower portion of the converter and extending along a portion of the load bearing mandrel for axial movement therewith, wherein gripping the wrench by the grabber and rotating the quill causes the nut and grapple to move axially; and wherein the axial movement of the grapple causes the grapple to move radially and engage a casing member.

10. The system of claim 9, wherein the grabber is configured to alternately clamp and release the wrench.

11. The system of claim 10, wherein:

the nut further comprises splines on an outer diameter surface of the nut; and wherein the cavity has an inner diameter larger than the outer diameter of the nut; and wherein the cavity has splines on an inner diameter surface that mate with the splines of the nut.

12. The system of claim 10, wherein the lower end of the load bearing mandrel defines a plurality of axially aligned conical surfaces having a smaller inner diameter proximate to the external threads, and a corresponding larger outer diameter proximate to the lower end of the load bearing mandrel.

13. The system of claim 9, further comprising:

a grapple mounting flange coupled to the nut; and wherein the grapple is coupled to the grapple mounting flange.

14. The system of claim 13, wherein an inner surface of the grapple comprises a plurality of ramps configured to engage a plurality of axially aligned conical surfaces on a portion of the lower end of the load bearing mandrel having a smaller inner diameter proximate to the external threads, and a corresponding larger outer diameter proximate to the lower end of the load bearing mandrel.

15. A method for gripping a casing with a top drive of a drilling rig having a grabber mounted to the top drive, the method comprising:

(a) providing a casing gripper having:

a load bearing mandrel having a central axis and external threads on a portion of the load bearing mandrel between an upper end and a lower end;

a rotary to linear converter enclosing a portion of the mandrel and inserted into the grabber, the converter having:

an upper portion and a lower portion, the lower portion being rotatable with the upper portion but axially movable relative to the upper portion;

a nut threaded over the external threads of the load bearing mandrel;

a wrench surrounding the nut and a portion of the load bearing mandrel above the nut, the upper portion of the wrench having an outer diameter smaller than the outer diameter of the lower portion of wrench;

the wrench and the nut being rotatable in unison, the nut being axially moveable relative to the wrench; and the wrench adapted to be inserted into and selectively secured by the grabber; and a grapple coupled to the lower portion of the converter and extending along a lower portion of the load bearing mandrel;

(b) gripping the upper portion of the converter with the grabber and securing the mandrel to the quill;

(c) positioning the grapple into reception with the casing; and (d) rotating the quill and the mandrel while holding the upper portion of the converter stationary with the grabber, which causes the lower portion of the converter and the grapple to move axially, the grapple moving radially in response to grip the casing.

16. The method of claim 15, wherein:

step (c) comprises stabbing the lower end of the load bearing mandrel and the grapple into the casing until an upper rim of the casing abuts a lower surface of a grapple mounting flange coupled to the nut; and step (d) comprises radially expanding the grapple into engagement with an inner diameter of the casing.

17. The method of claim 15, further comprising rotating the quill in an opposite direction causing the lower portion of the converter and the grapple to move in an axially opposite direction and causing the grapples to move radially in an opposite direction to release the casing.

18. The method of claim 17, the method further comprising:

releasing the grabber from gripping engagement with the converter; and rotating the quill in the same direction, which causes the mandrel, converter, and grapple to rotate in unison.

* * * * *